US007631623B2

(12) United States Patent
Mizuno

(10) Patent No.: US 7,631,623 B2
(45) Date of Patent: Dec. 15, 2009

(54) VALVE TIMING CONTROLLER

(75) Inventor: Daisuke Mizuno, Kariya (JP)

(73) Assignee: DENSO Corporation, Kariya (JP)

( * ) Notice: Subject to any disclaimer, the term of this patent is extended or adjusted under 35 U.S.C. 154(b) by 145 days.

(21) Appl. No.: 11/826,425

(22) Filed: Jul. 16, 2007

(65) Prior Publication Data

US 2008/0047508 A1 Feb. 28, 2008

(30) Foreign Application Priority Data

Aug. 22, 2006 (JP) ..... 2006-225801

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 4,227,505 A * 10/1980 Larson et al. ..... 123/198 F
5,291,365 A * 3/1994 Takagi ..... 361/56
6,956,349 B2 10/2005 Tani et al.
7,077,087 B2 7/2006 Tani
7,148,640 B2 12/2006 Tani
2005/0081808 A1* 4/2005 Tani et al. ..... 123/90.17

FOREIGN PATENT DOCUMENTS

JP 06-253580 9/1994
JP 10-339123 12/1998
JP 2005-171990 6/2005

OTHER PUBLICATIONS

Office Action dated Jul. 28, 2009 issued in corresponding Japanese Application No. 2006-225801 with an at least partial English language translation thereof.

* cited by examiner

*Primary Examiner*—Zelalem Eshete
(74) *Attorney, Agent, or Firm*—Nixon & Vanderhye P.C.

(57) ABSTRACT

A valve timing controller includes a driving circuit, a control circuit, and a signal line. Receiving electric power from a power source, the drive circuit drives an electric motor according to the control signal, and outputs the rotative direction signal showing the rotation direction of the electric motor. A controlling circuit outputs the control signal generated according to the rotation-direction signal. A signal line transmits the rotation-direction signal to the controlling circuit from the drive circuit. The drive circuit outputs a high-level signal showing the normal rotation direction, and a low level signal showing the reverse rotation direction of the electric motor. When a power supply voltage falls below to the acceptable value, the drive circuit maintains the voltage level of the signal line at high level.

2 Claims, 5 Drawing Sheets

VALVE TIMING CONTROLLER

CROSS-REFERENCE TO RELATED APPLICATION

This application is based on Japanese Patent Application No. 2006-225801 filed on Aug. 22, 2006, the disclosure of which is incorporated herein by reference.

FILED OF THE INVENTION

The present invention relates to a valve timing controller which adjusts valve timing of at least one of an intake valve and an exhaust valve by energizing an electric motor in a normal direction or a reverse direction.

BACKGROUND OF THE INVENTION

JP-2005-330956A (corresponding to U.S. Pat. No. 7,077,087B2) shows a valve timing controller which includes an electric motor, a drive circuit, and a control circuit. The control circuit generates a control signal according to a rotation direction of an electric motor. The drive circuit energizes the electric motor according to the control signal. A motor rotation signal indicative of a rotation direction of the motor is generated by the driving circuit and is outputted into the control circuit.

In a case that a power source voltage supplied to the drive circuit is dropped, or a break is occurred in a signal line through which a motor rotation signal is transmitted from the driving circuit to the control circuit, it might be possible that the control circuit does not recognize the rotation direction of the electric motor. If the control circuit erroneously recognizes the rotation direction and generates a control signal based on the erroneous rotation direction, it may cause a trouble in operating the engine.

SUMMARY OF THE INVENTION

The present invention has been made in view of the foregoing problem. It is an object of the present invention to provide a valve timing controller which has high reliability.

According to the present invention, a valve timing controller includes a driving circuit, a control circuit, and a signal line. The control circuit drives the electric motor according to an inputted control signal and generates a rotation-direction signal indicating a rotation direction of the electric motor. The control circuit outputs the control signal which is generated according to the rotation-direction signal. The signal line transmits the rotation-direction signal from the driving circuit to the control circuit. The driving circuit outputs a high-level-voltage signal as the rotation-direction signal indicating the normal rotation direction and a low-level-voltage signal as the rotation-direction signal indicating the reverse rotation direction.

When the power source voltage falls lower than or equal to a permissible value, a voltage level of the signal line is maintained at high level.

According to another aspect of the invention, when the signal line is broken, a voltage level of the signal line is maintained at high level.

DETAILED DESCRIPTION OF THE PREFERRED EMBODIMENTS

Figure 1:
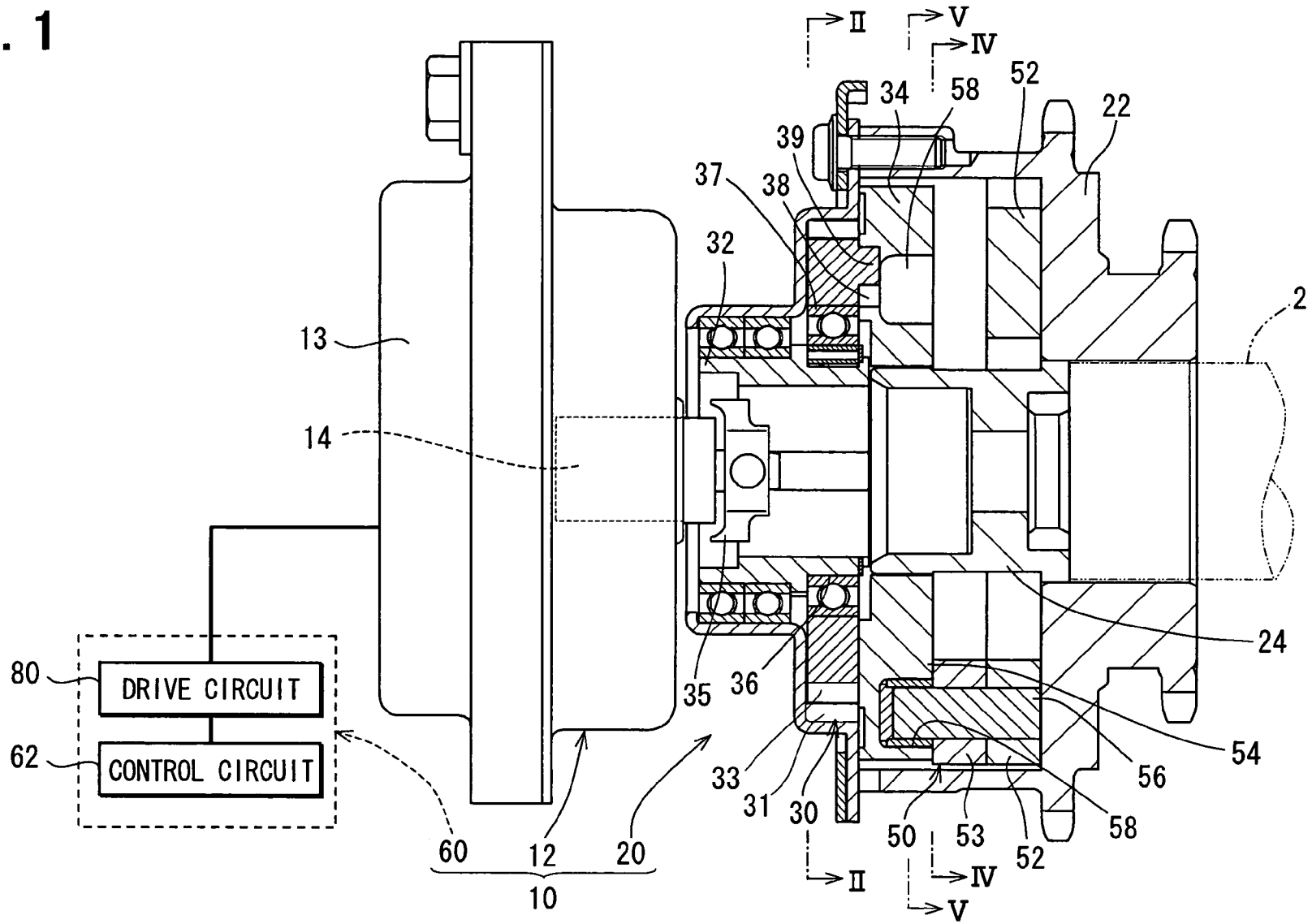
FIG. 1 is a cross sectional view showing a valve timing controller, taken along a line I-I in FIG. 4.

FIG. 1 is a cross sectional view of a valve timing controller 1. The valve timing controller 10 is provided in a torque transfer system which transfers the torque of a crankshaft (not shown) to a camshaft 2 of an engine. The valve timing controller 10 adjusts a valve timing of an intake valve or an exhaust valve by use of an electric motor 12.

The electric motor 12 is a brushless motor having a motor case 13, a motor shaft 14 and a coil (not shown). The motor case 13 is fixed on the engine through a stay (not shown). The motor case 13 supports the motor shaft 14 and accommodates the coil therein. When the coil of the motor 12 is energized, a rotating magnetic field is generated in a clockwise direction to rotate the motor shaft 14 in a normal direction. When the coil is energized to generate the rotating magnetic filed in counterclockwise direction, the motor shaft 14 is rotated in a reverse direction.

Figure 3:
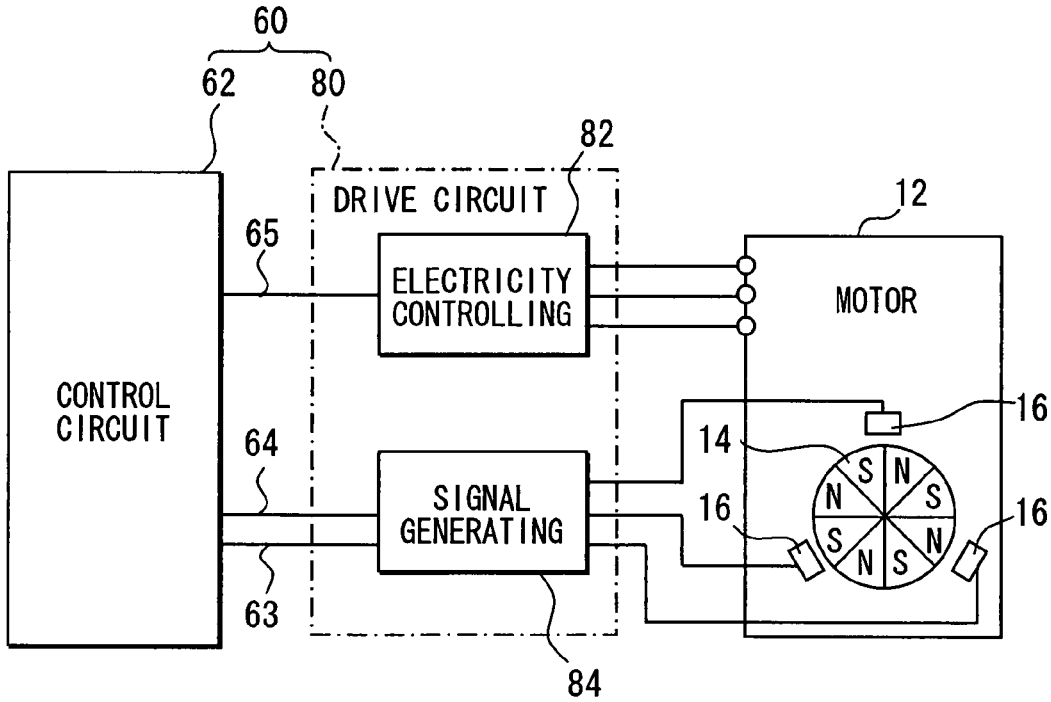
FIG. 3 is a block diagram showing an electric circuit.

As shown in FIG. 3, the electric motor 12 is provided with rotation angle sensors 16. The rotation angle sensors 16 are Hall elements that are arranged around the motor shaft 14 at regular intervals. The rotation angle sensors 16 output sensor-signals of which voltage level is varied according to a rotational position of magnetic poles N, S of the motor shaft 14.

Referring to FIG. 1, a phase-change unit 20 will be described hereinafter. The phase-change unit 20 includes a drive-rotation member 22, a driven-rotation member 24, a differential gear mechanism 30, and a link mechanism 50.

The drive-rotation member 22 is a timing sprocket around which a timing chain is wound to receive a driving force from a crankshaft of the engine. The drive-rotation member 22 rotates in accordance with the crankshaft in the clockwise direction in FIG. 4, while maintaining the same rotational phase as the crankshaft. The driven-rotation member 24 is coaxially fixed to the camshaft 2 and rotates in the clockwise direction along with the camshaft 2. The normal direction of the motor shaft 14 is the same as the rotation direction of the engine, and the reverse direction of the motor shaft 14 is counter to the rotation direction of the engine.

Figure 2:
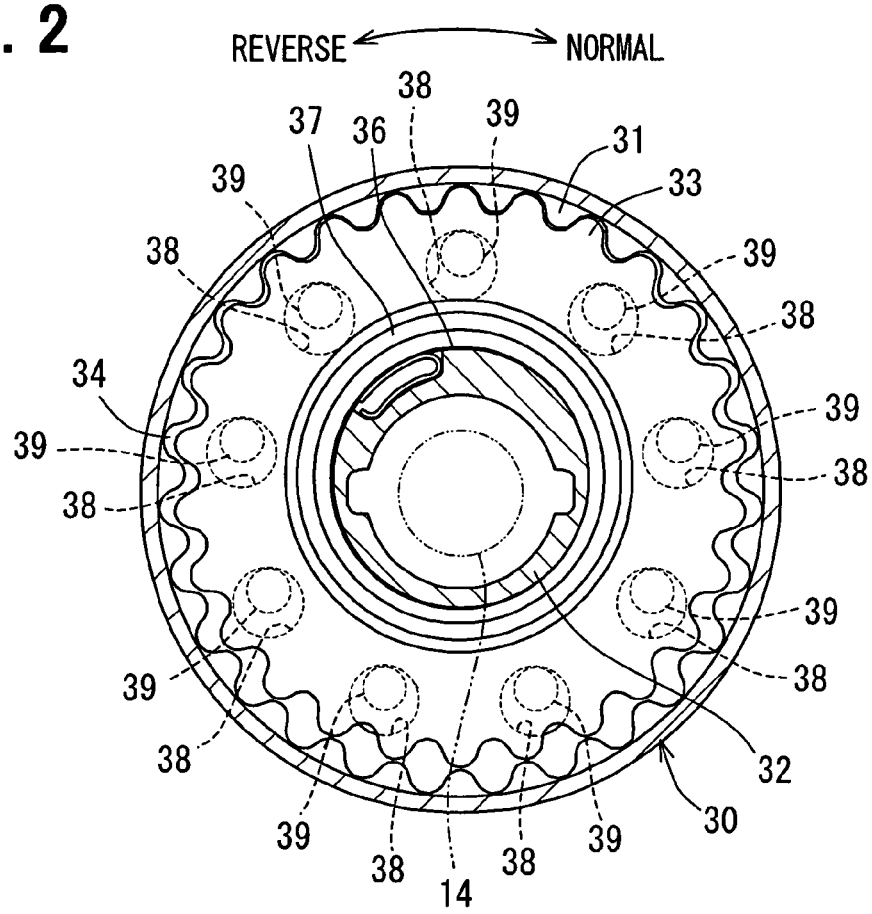
FIG. 2 is a cross sectional view taken along a line II-II in FIG. 1.

As shown in FIGS. 1 and 2, the differential gear mechanism 30 includes a sun gear 31, a planetary carrier 32, a planetary gear 33, and a guide-rotation member 34. The sun gear 31 is an internal gear, which is coaxially fixed to drive-rotation member 22, and rotates along with the drive-rotation member 22 by receiving an output torque of the crankshaft. The planetary carrier 32 is connected to the motor shaft 14 through a joint 35 to rotate along with the motor shaft 14 by receiving the rotation torque from the motor shaft 14. The planetary carrier 32 has an eccentric portion 36 of which outer surface is eccentric with respect to the drive-rotation member 22. The planetary gear 33 is an external gear which is engaged with the eccentric portion 36 through a bearing 37, so that the planetary gear 33 is eccentric with respect to the sun gear 31. The planetary gear 33 engages with the sun gear 31 from its internal side, and performs a planetary motion in accordance with a relative rotation of the motor shaft 14 with respect to the drive-rotation member 22. The guide-rotation member 34 coaxially engages with an outer surface of the driven-rotation member 24. The guide-rotation member 34 is provided with a plurality of engaging holes 38 which are arranged in the rotation direction at regular intervals. The planetary gear 33 is provided with a plurality of engaging protrusions 39 which are engaged with the engaging holes 38, so that a rotational movement of the planetary gear 33 is converted into the rotational movement of the guide-rotation member 34.

Figure 4:
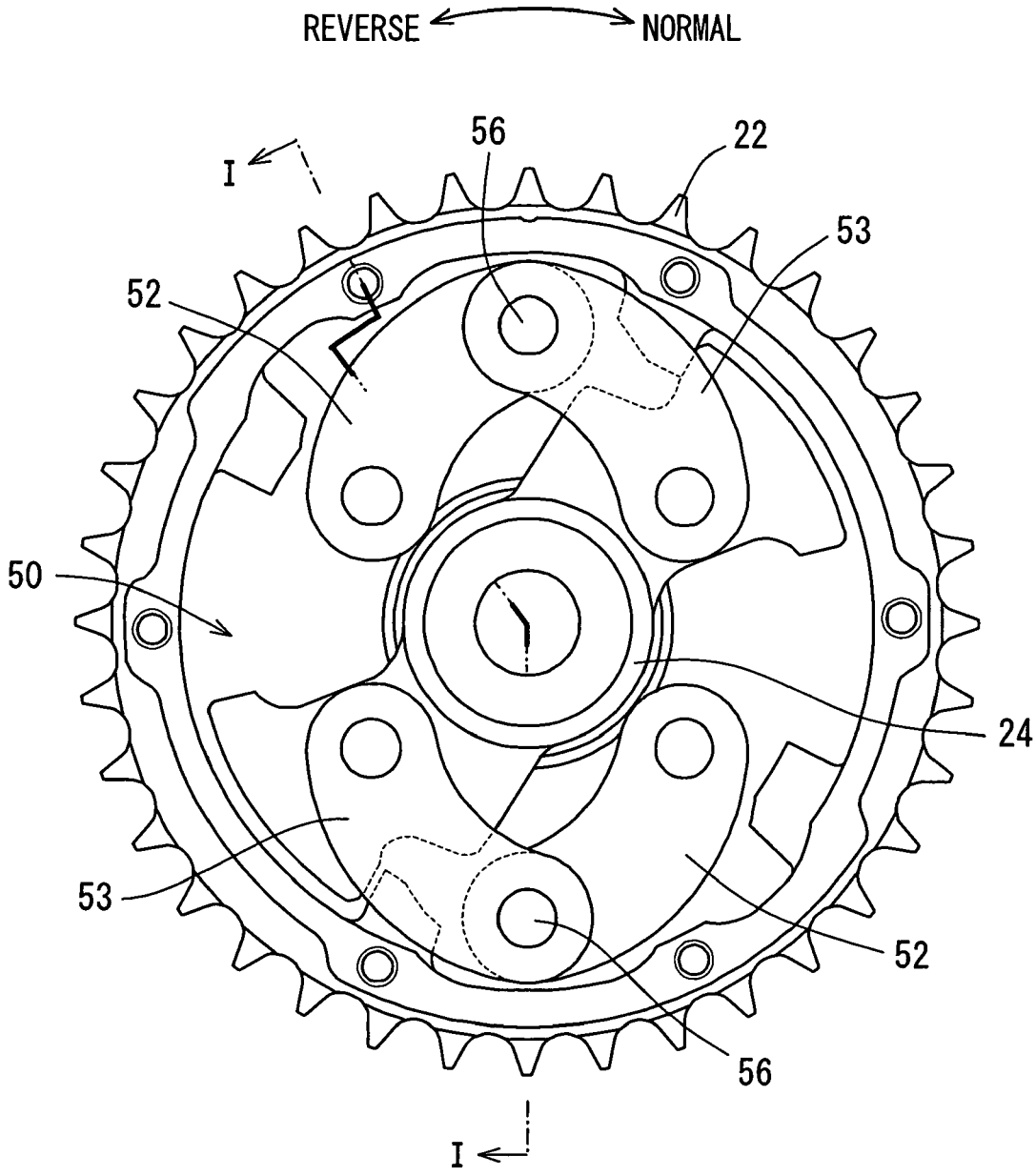
FIG. 4 is a cross sectional view taken along a line IV-IV in FIG. 1.
Figure 5:
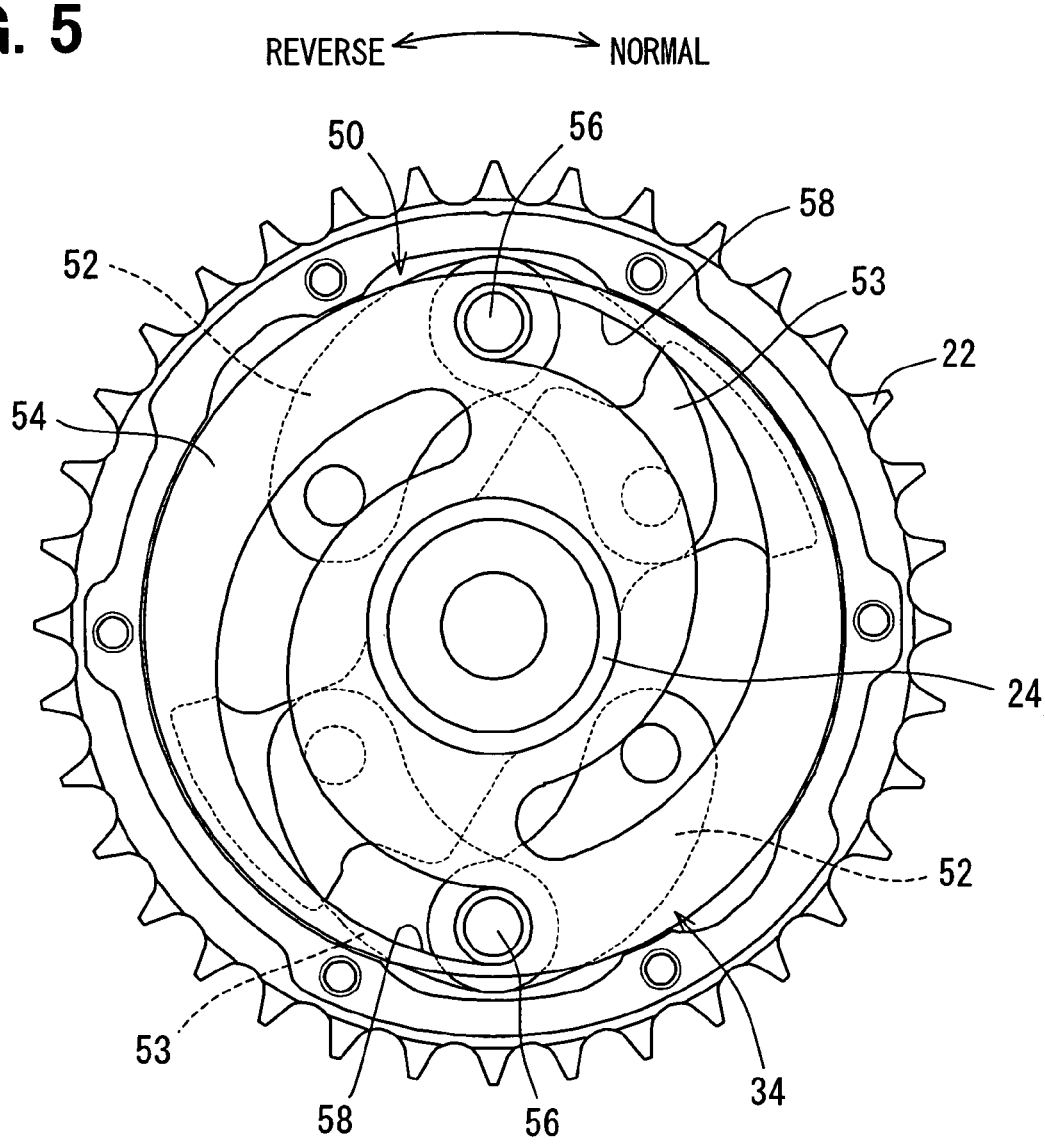
FIG. 5 is a cross sectional view taken along a line V-V in FIG. 1.

As shown in FIGS. 4 and 5, the link mechanism 50 includes a first link 52, a second link 53, a guide portion 54, and a movable member 56. In FIGS. 4 and 5, hatching showing cross sections are not illustrated. The first link 52 is connected to the drive-rotation member 22 by a revolute pair. The second link 53 is connected to the driven-rotation member by a revolute pair and is connected to the first link 52 through the movable member 56. As shown in FIGS. 1 and 5, the guide portion 54 is formed in the guide-rotation member 34 at a side opposite to the planetary gear 33. The guide portion 54 is provided with guide grooves 58 in which the movable member 56 slides. The guide grooves 58 are spiral grooves such that the distance from the rotation center varies along its extending direction.

In a case that the motor shaft 14 does not relatively rotate with respect to the drive-rotation member 22, the planetary gear 33 does not perform the planetary motion so that the drive-rotation member 22 and the guide-rotation member 34 rotates together. As the result, the movable member 56 does not move in the guide groove 58 and the relative position between the first link 52 and the second link 53 does not change, so that the relative rotational phase between the drive-rotation member 22 and the driven-rotation member 24 is maintained, that is, the instant valve timing is maintained. Meanwhile, in a case that the motor shaft 14 relatively rotates with respect to the drive-rotation member 22 in the clockwise direction, the planetary gear 33 performs the planetary motion so that the guide-rotation member 34 relatively rotates with respect to the drive-rotation member 22 in the counterclockwise direction in FIG. 5. As the result, the relative position between the first link 52 and the second link 53 is varied, and the driven-rotation member 24 relatively rotates with respect to the drive-rotation member 22 in the clockwise direction so that the valve timing is advanced. In a case that the motor shaft 14 relatively rotates in the counterclockwise direction, the valve timing is retarded.

A period during which the electric motor 12 rotates in the reverse direction is longer than a period during which the electric motor 12 rotates in the normal direction.

Referring to FIG. 3, an electric circuit 60 will be described hereinafter. The electric circuit 60 includes a control circuit 62 and a drive circuit 80. The control circuit 62 is connected to the drive circuit 80 through signal lines 63, 64, 65. The control circuit 62 receives a rotation-direction signal and a rotation-speed signal through the signal lines 63, 64, 65. The rotation-direction signal represents an actual rotation direction D of the motor 12, and the rotation-speed signal represents an actual rotation speed R of the motor 12. The control circuit 62 calculates an actual valve timing based on the rotation-direction signal and the rotation-speed signal, and sets a target valve timing based on the throttle position, an oil temperature, and the like. Furthermore, the control circuit 62 determines a target rotation direction "d" and a target rotation speed "r" of the electric motor 12 based on a differential phase between the actual valve timing and the target valve timing, and generates control signals indicative of "d" and "r". The control signals are transmitted from the control circuit 62 into to the drive circuit 80 through the signal line 65.

The drive circuit 80 includes an electricity controlling part 82 and a signal generating part 84. The electricity controlling part 82 is connected to the signal line 65, and extracts the target rotation direction "d" and the target rotation speed "r". The electricity controlling part 82 is connected to the coil of the motor 12, and controls the voltage applied to the motor 12 based on the target rotation direction "d" and the target rotation speed "r".

Figure 6:
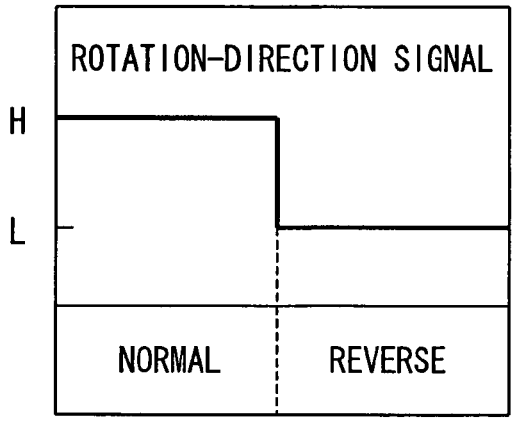
FIG. 6 is a chart for explaining an operation of a signal generating part.

The signal generating part 84 is connected to the rotation angle sensors 16. The signal generating part 84 calculates the actual rotation direction D and the actual rotation speed R based on the sensor signals from the sensors 16. Furthermore, the signal generating part 84 generates the rotation-direction signal indicative of the actual rotation direction D and the rotation-speed signal indicative of the actual rotation speed R. As shown in FIG. 6, a voltage level of the rotation-direction signal varies between high level "H" and low level "L" according to the actual rotation direction D. Specifically, when the actual rotation direction D is normal rotation direction, the voltage level of the rotation-direction signal is set at high level "H". When the actual rotation direction D is reverse direction, the voltage level of the rotation-direction signal is set at low level "L". The rotation-direction signal and the rotation-speed signal are transmitted to the control circuit 62 through the signal lines 63, 64.

Figure 7:
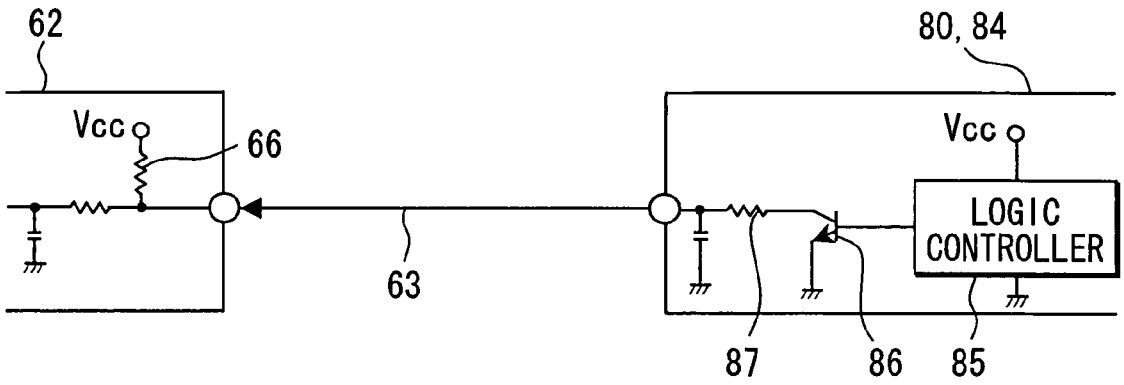
FIG. 7 is a block diagram showing a feature portion of the electric circuit.

As shown in FIG. 7, in the control circuit 62, the signal line 63 is connected to a power source Vcc through a resistor 66 as a pull-up resistor. The voltage level is set at the high level "H" when the signal line 63 is in a non-active condition.

In the signal generating part 84 of the drive circuit 80, the base of the transistor 86 is connected to the logic controller 85, the collector is connected to the signal line 63 through the resistor 87, and the emitter is grounded. Moreover, the logic controller 85 is connected to the power source Vcc, and receives the power supply voltage at least during the operation of the internal combustion engine. The logic controller 85 generates the driving signal from the power source Vcc so as to turn on/off the transistor 86 according to the driving signal.

Figure 8:
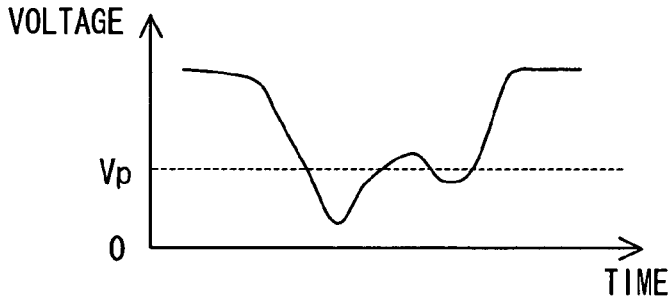
FIG. 8 is a chart for explaining an operation of the electric circuit.
Figure 9:
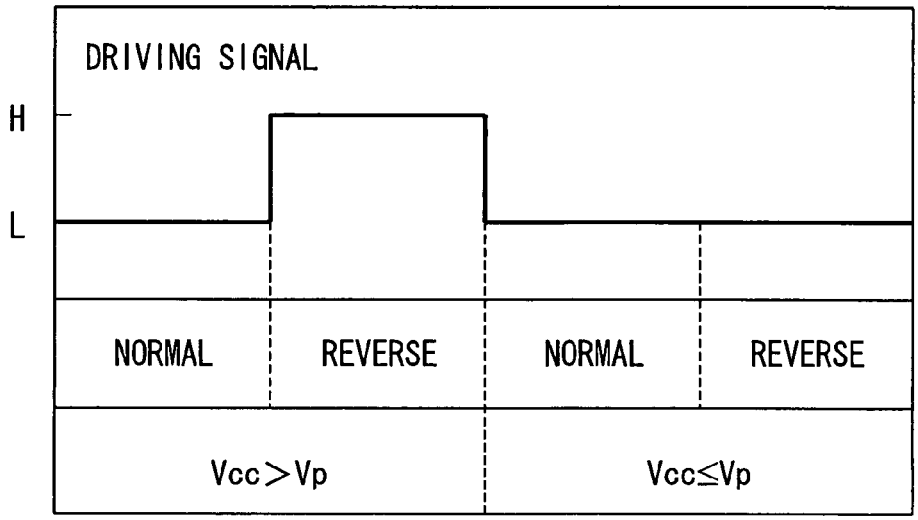
FIG. 9 is a chart for explaining an operation of the electric circuit.

Specifically, when the voltage of the power source Vcc is higher than an acceptable value Vp in FIG. 8 and the actual rotation direction D is the normal rotation direction, as shown in FIG. 9, the logic controller 85 sets the voltage level of the driving signal at the low level "L". As a result, since the transistor 86 is turned off, the signal line 63 is brought to the non-active condition, and the rotation-direction signal which represents the normal direction as the actual rotation direction D is inputted into the control circuit 62. Besides, since the rotation-direction signal representing the normal direction is generated by tuning off the transistor 86, it becomes possible to reduce power consumption.

Moreover, when the voltage of the power source Vcc is higher than the acceptable value Vp and the actual rotation direction D is the reverse rotation direction, the logic controller 85 establishes the voltage level of the driving signal as the high level "H", as shown in FIG. 9. As a result, the transistor 86 is turned on, so that the signal line 63 is brought to the active condition, and the rotation-direction signal of low level "L" is inputted into the controlling circuit 62 as the actual rotation direction D.

Meanwhile, when the voltage of the power source Vcc is lower than or equal to the acceptable value Vp, it may be impossible to secure the voltage level of the driving signal by the logic controller 85. As shown in FIG. 9, the voltage level of the driving signal falls to the low level "L" regardless of the actual rotation direction D. As a result, the transistor 86 is turned off, so that the signal line 63 is brought to the non-active condition, and the voltage level of the signal line 63 is maintained at the high level "H". Therefore, since the rotation-direction signal of high level "H" showing the normal rotation direction where implementation time is long as the actual rotation direction D is inputted into the controlling circuit 62, an accuracy of the actual rotation direction D recognized from the rotation-direction signal is enhanced. According to the present embodiment, a high fail-safe is obtained against the fluctuation in voltage of the power source Vcc, so that the operation of the internal combustion engine is well performed.

Furthermore, according to the present embodiment, when the signal line 63 is broken, the signal wire 63 which is pulled-up to the controlling-circuit 62 is fixed to the non-active condition, and the voltage level of the signal line 63 is maintained as the high level "H". As a result, since the rotation-direction signal of the high level "H" showing the normal rotation direction where implementation time is long as the actual rotation direction D is inputted into the controlling circuit 62, the accuracy of the actual rotation direction recognized from the rotation-direction signal is enhanced. According to the present embodiment, a high fail-safe is obtained against the brake of the signal line 63 between the circuits 62, 80, so that the operation of the internal combustion engine is well performed.

Besides, in the embodiment described above, the resistor 66 of the controlling circuit 62 is equivalent to the "pull-up resistor", the logic controller 85 is equivalent to the "driving signal generating part", and the transistor 86 is equivalent to the "switching element."

The present invention is limited to the above embodiment, but may be implemented in other ways without departing from the spirit of the invention.

For example, the structure of the controlling circuit 62 and the drive circuit 80 can be suitably changed, as long as the advantage of the present invention is obtained.

Moreover, the phase-changing unit is employable suitably, when the valve timing can be adjusted by varying the relative phase between the crankshaft and the camshaft 2 using the electric motor 12.

What is claimed is:

1. A valve timing controller for an internal combustion engine, the valve timing controller adjusting a valve timing of at least one of an intake valve and an exhaust valve by driving an electric motor in a normal rotation direction or a reverse rotation direction, comprising:

a driving circuit for driving the electric motor by applying electricity to the electric motor according to an inputted control signal and for generating a rotation-direction signal indicating a rotation direction of the electric motor while receiving a power source voltage;

a control circuit for outputting the control signal which is generated according to the rotation-direction signal; and a signal line for transmitting the rotation-direction signal from the driving circuit to the control circuit, wherein the driving circuit outputs a high-level-voltage signal as the rotation-direction signal indicating the normal rotation direction and a low-level-voltage signal as the rotation-direction signal indicating the reverse rotation direction, and when the power source voltage falls lower than or equal to a permissible value, a voltage level of the signal line is maintained at high level;

the control circuit includes a pull-up resistor for pulling-up the signal line, the driving circuit includes a signal generating part which generates a driving signal from the power source voltage, the signal generating part sets the voltage level of the driving signal at low-level when the power source voltage is higher than the permissible value and the rotation direction is the normal rotation direction, the signal generating part sets the voltage level of the driving signal at high-level when the power source voltage is higher than the permissible value and the rotation direction is the reverse rotation direction, the signal generating part sets the voltage level of the driving signal at low-level regardless of the rotation direction when the power source voltage is lower than or equal to the permissible value, and the driving circuit includes a switching device which turns off based on the driving signal of low-level such that the signal line is brought to a non-active condition, and turns on based on the driving signal of high-level such that the signal line is brought to an active condition.

2. A valve timing controller for an internal combustion engine, the valve timing controller adjusting a valve timing of at least one of an intake valve and an exhaust valve by driving an electric motor in a normal rotation direction or a reverse rotation direction, comprising:

a driving circuit for driving the electric motor by applying electricity to the electric motor according to an inputted control signal and for generating a rotation-direction signal indicating a rotation direction of the electric motor while receiving a power source voltage;

a control circuit for outputting the control signal which is generated according to the rotation-direction signal; and a signal line for transmitting the rotation-direction signal from the driving circuit to the control circuit, wherein the driving circuit outputs a high-level-voltage signal as the rotation-direction signal indicating the normal rotation direction and a low-level-voltage signal as the rotation-direction signal indicating the reverse rotation direction, and when the signal line is broken, a voltage level of the signal line is maintained at high level;

the control circuit includes a pull-up resistor for pulling-up the signal line:

the driving circuit includes a signal generating part which generates a driving signal from the power source voltage, the signal generating part sets the voltage level of the driving signal at low-level when the rotation direction is the normal rotation direction and sets the voltage level of the driving signal at high-level when the rotation direction is the reverse rotation direction, and the driving circuit includes a switching device which turns off based on the driving signal of low-level such that the signal line is brought to a non-active condition, and turns on based on the driving signal of high-level such that the signal line is brought to an active condition.

* * * * *